US011588275B2

(12) United States Patent
Pacher et al.

(10) Patent No.: US 11,588,275 B2
(45) Date of Patent: Feb. 21, 2023

(54) ELECTRICAL INTERFACE ASSEMBLY

(71) Applicant: Aptiv Technologies Limited, St. Michael (BB)

(72) Inventors: Franz Pacher, Roth (DE); Reinhard Hinteregger, Bad Kleinkirchheim (AT); Prasanna Ramakrishnan, Tamilnadu (IN)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 52 days.

(21) Appl. No.: 17/330,800

(22) Filed: May 26, 2021

(65) Prior Publication Data

US 2021/0376523 A1 Dec. 2, 2021

(30) Foreign Application Priority Data

May 27, 2020 (DE) ..... 10 2020 206 618.3

(51) Int. Cl.
*H01R 13/627* (2006.01)

(52) U.S. Cl.
CPC ..... *H01R 13/6273* (2013.01)

(58) Field of Classification Search
CPC ..... H01R 13/4226; H01R 13/4223; H01R 13/113; H01R 13/6273
USPC ..... 439/744, 752.5
See application file for complete search history.

(56) References Cited

U.S. PATENT DOCUMENTS 4,187,272 A * 2/1980 Bourdon ..... H01R 13/4226 264/318
4,364,621 A * 12/1982 Janvrin ..... H01R 13/521 439/595
4,374,604 A 2/1983 Hemmer et al.
10,396,485 B1 * 8/2019 Smoll ..... H01R 13/41
2011/0014822 A1 * 1/2011 Kato ..... H01R 13/65912 439/733.1
2019/0190179 A1 * 6/2019 Probert ..... H01R 13/4226

FOREIGN PATENT DOCUMENTS

CN 202142747 U 2/2012

OTHER PUBLICATIONS

German Search Report for DE Application No. 102020206618.3, dated Feb. 2, 2021, 10 pages.

* cited by examiner

*Primary Examiner* — Gary F Paumen
(74) *Attorney, Agent, or Firm* — Billion & Armitage

(57) ABSTRACT

An interface assembly includes an interface housing including a receiving portion arranged inside an interface cavity of the interface housing, for receiving an electrical contact element. The interface housing further includes at least two latches and an electrical contact element for transferring electrical power. The electrical contact element includes a busbar portion and a plug-in portion. The busbar portion includes at least two latching noses. Each of the at least two latching noses is assigned to one of the at least two latches to block a release movement of the assigned latching nose upon mating of the electrical contact element and the interface housing.

20 Claims, 4 Drawing Sheets

ELECTRICAL INTERFACE ASSEMBLY

CROSS-REFERENCE TO RELATED APPLICATION

This application claims benefit of priority to German Patent Application No. DE 10-2020-206618.3 filed in the Deutsches Patent-und Markenamt on May 27, 2020, the entire disclosure of which is hereby incorporated by reference.

TECHNICAL FIELD OF THE INVENTION

The present disclosure relates to the field of electrical interface assemblies, particularly to interface assemblies for electrical power connectors. Further, the invention relates to an electrical connector. An electrical interface assembly according to the invention, is typically used in vehicles, particularly in the vehicle electrical system.

BACKGROUND

During vehicle operation, different electrical devices, e.g., an ignition and fuel-injection system, control units, safety and comfort and convenience electronics, infotainment systems, lighting, and/or other equipment, have to be supplied with electrical power. For powering the electrical devices, these have to be connected to a power source, such as a vehicle's battery or generator.

A vehicle electrical system, which may be a closed circuit, connects the single electrical devices to the respective power source(s) of the vehicle, and thus powers the respective devices. The devices and the power source(s) of the vehicle electrical system are typically connected via at least one cable harness. At an electrical interface between two components of the vehicle electrical system (i.e., a device, a power source, a cable and/or a cable harness) electrical connectors are typically provided.

Conventional vehicle electrical systems run at 12 volts. However, there is a trend to vehicle electrical systems running at higher voltages, such as 42 volts or 48 volts. These higher voltage vehicle electrical systems can be provided instead of or additionally to the conventional vehicle electrical systems that run at 12 volts.

These higher voltage vehicle electrical systems allow to provide more power, compared to conventional 12-volt systems. This is, as e.g., a wire of a given size can carry four times as much power at 48 volts as at 12 volts at the same current (amps).

Thus, higher voltage vehicle electrical systems allow for lighter cable harnesses, as more power can be transmitted, at a given wire size. Further, the increasing power demand of the vehicle's electrical devices can be satisfied by establishing higher voltage vehicle electrical systems, as more power can be transferred.

While conventional 12-volt systems may still be used for conventional lighting and infotainment, higher voltage vehicle electrical systems may be used for powering more energy consuming components, such as electrically driven turbochargers, air conditioning, electrical starting assistance systems, and the like. Further, higher voltage vehicle electrical systems allow to provide the electrical energy for electrically powered vehicles, a facilitated recuperation of energy during braking, thereby reducing fuel consumption and $CO_2$ emissions, etc.

However, with increasing voltage and higher power transmission, the requirements for the electrical interface between two components of the vehicle electrical system increase, i.e., the requirements for electrical connectors and interface assemblies, respectively.

These increased requirements lead inter alia to increased security measures of the connectors and the interface assemblies. For example, to prevent the risk of electrical shocks, electrostatic shielding is often applied. To further omit unintended loosening of connector-components, e.g., connectors and counter-connectors or cables attached to connectors, in particular if used for power transmission, a firm fixation of these respective components is often required. For example, busbar elements for electrical power distribution from the battery to various devices are often permanently attached to the interface by pressing the busbar element into a plastic housing. To remove the busbar element, in particular for servicing, at least a part of the plastic housing needs to be broken and replaced by a new plastic housing or a new part of the plastic housing. This leads to a high number of plastic components discarded after a single usage. Further, the time used for replacing various broken parts of the plastic housings during maintenance increases the costs of interval servicing of a car immensely. Thus, there is a need in the art to overcome the aforementioned drawbacks.

SUMMARY

The drawbacks described in the preceding Background section are at least partially overcome by an interface assembly for an electrical power connector and an electrical connector described herein.

Particularly, these drawbacks are at least partially overcome by an interface assembly for an electrical power connector including an interface housing and an electrical contact element for transferring electrical power. The interface housing includes a receiving portion arranged inside an interface cavity of the interface housing for receiving an electrical contact element and the interface housing includes at least two latches. The electrical contact element for transferring electrical power includes a busbar portion and a plug-in portion, wherein the busbar portion includes at least two latching noses. Each of the at least two latching noses is assigned to one of the at least two latches to block a release movement of the assigned latching nose upon mating of the electrical contact element and the interface housing.

In this manner, the present disclosure provides an interface assembly, in which the electrical contact element may be firmly fixed at the interface housing after mating. Additionally, if required for servicing or other reasons, a mechanic or even a similarly skilled person can easily release the electrical contact element from the interface housing by unlatching the at least two latching noses from the respective latches. The latching system according to the present disclosure can thus be reused various times. Moreover, the time needed for servicing may be reduced, since exchanging of single use fixation means can be omitted.

The interface housing may include an essentially cylindrical wall component. By the term "essentially cylindrical" the present disclosure also includes shapes and forms which deviate from a mathematical definition of a cylinder. Therefore, according to the present disclosure, not all points on a cylindrically curved surface, as required e.g., for a mathematically circular cylinder, need to have the same distance, i.e., radius, from a central axis of the cylinder. Small deviations of up to 10% or similar are still referred to as being essentially cylindrical. Furthermore, elliptical cylinders or portions of a cone, in which an apex is located outside the cone, may also be applicable. Further, the axis of the wall component may extend in mating direction of the electrical contact element. In this manner, the wall component may enclose the interface cavity at least partially. The wall component may be configured to mechanically and/or electrically shield the interface cavity at least partially.

The at least two latches can be arranged at the interior surface of the cylindrical wall component. Thus, the at least two latches may be shielded by the cylindrical wall component. Furthermore, in this arrangement an unintended unlatching of the at least two latches may be avoided, or the chances at least reduced compared to latches arranged on an exterior surface.

In some embodiments of the present disclosure, each of the at least two latches can be arranged on a respective spring element of the cylindrical wall component, that is configured to elastically deflect in a direction perpendicular to the mating direction. The spring element may be configured to elastically deflect during mating and/or during un-mating of the electrical contact element and the interface housing. The spring element may be in contact to the cylindrical wall component. The spring element can optionally be not in contact to the interface housing. Each spring element may be integrally formed with the cylindrical wall component. In this manner, a cost-efficient manufacture of the wall component and the spring element, for example by injection moulding, may be possible. However, other manufacturing techniques may be also applicable.

In some embodiments of the present disclosure, the essentially cylindrical wall component may resemble a segment of a hollow cylinder. A hollow cylinder, as referred to by the present disclosure, may correspond to a shell of a cylinder having a respective thickness. The respective thickness of the shell or the thickness of the essentially cylindrical wall component may range between 1.5 mm and 3 mm. A diameter of the essentially cylindrical wall component may range between 30 mm and 60 mm. The diameter may be determined between two opposite points on the outer surface of the wall component. A center angle of a base of the hollow cylinder may amount between 120° and 360°, preferably between 180° and 300° and most preferably between 190° and 270°. Thus, the essentially cylindrical wall component may preferably be configured to not fully encircle the interface cavity but provide open edges. In this manner, the respective spring element can be arranged on the open edge of the cylindrical wall component.

In some embodiments of the present disclosure, the busbar portion may include a fixation portion configured to hold the plug-in portion. The fixation portion may be attached to the busbar portion or alternatively may be formed integrally with the busbar portion. If the busbar portion and the fixation portion are formed integrally, the fixation portion may be formed by bending one end of the busbar portion. The fixation portion may extend perpendicular to the mating direction. The term perpendicular, as used in the present disclosure, may also include small deviations from exact 90° in the order of 10°. Further the fixation portion may include an outer guiding contour, wherein the interface housing may include a corresponding contour arranged inside the interface cavity. In this manner, the fixation portion may guide the electrical contact element during mating. Additionally, or alternatively, the fixation portion may be configured to prevent the electrical contact element from unintentionally rotating within the interface cavity after mating. Moreover, the fixation portion may provide, in combination with the latching system, a firm placement of the electrical contact element within the interface housing at least partially.

In some embodiments of the present disclosure, the electrical contact element may be configured to transfer electrical power of at least 5 kW, preferably at least 10 kW, more preferably at least 20 kW and most preferably 30 kW. The electrical contact element may be configured to transfer electrical power to/or from an electrical device, a power source, a cable and/or a cable harness. Particularly, the electrical contact element may be configured to be used in a higher voltage vehicle electrical system, such as a 48 volts vehicle electrical system.

In some embodiments of the present disclosure, the at least two latching noses may be arranged on opposite sides of the busbar portion extending perpendicular to the mating direction of the electrical contact element in a plane of the busbar portion. In this manner, the positioning of the at least two latching noses may be advantageously configured to provide a firm fixation of the electrical contact element inside the interface housing. Further, the latching noses can be integrally formed with the busbar portion, thus providing a cost-efficient manufacture.

In some embodiments of the present disclosure, a portion of each latch, configured to slide along the assigned latching nose during mating, may include a first inclined surface. The first inclined surface may be configured to reduce the friction of the latching nose and the latch at least partially. The portion of each latch may be further configured, so that a surface normal of the first inclined surface points towards mating direction of the electrical contact element.

In some embodiments of the present disclosure, a portion of each latching nose, assigned to slide along the first inclined surface of the corresponding latch during mating, may include a second inclined surface, so that the first inclined surface of the latch and the second inclined surface of the latching nose can be arranged essentially parallel during mating. By providing two essentially parallel surfaces, sliding along of each other, the attrition of the first and second surface may be reduced compared to non-inclined surfaces. The term essentially parallel includes also small deviations of exact parallel surfaces in the order of 10°. In particular, the term essentially parallel includes deviations which occur during mating based on an elastically deflection of the at least two latches.

In some embodiments of the present disclosure, the busbar portion, when seen from the receiving portion along mating direction of the electrical contact element, may include a recess subsequent to the latching nose, wherein the recess extends in the plane of the busbar portion and is configured that the first inclined surface of each of the latches can be received within the recess after mating. In this manner, not only a part of the latching nose may latch into the latch, but also at least a part of the latch, in particular the part including the first inclined surface, may latch into the recess. Thus, an improved firm fixation of the electrical contact element and the interface housing may be provided by the present embodiment.

In some embodiments of the present disclosure, the plug-in portion may include an essentially cylindrical shape including a diameter perpendicular to the mating direction of the electrical contact element between 6 mm and 10 mm and/or a length in the mating direction between 30 mm and 50 mm. In this manner, the electrical contact element may be configured by its dimensions to be used in a higher voltage vehicle electrical system, such as a 48 volts vehicle electrical system. The length of the plug-in portion may be defined as reaching from the tip of the plug-in portion until the fixation portion. Further, the provided dimensions of the plug-in portion may include optimized dimensions for transferring the required electrical power in a higher voltage vehicle electrical system.

The above-described drawbacks are further at least partially overcome by an electrical connector including an interface assembly, as described above, and a housing that houses a plug-in portion of an electrical contacting element at least partly.

BRIEF DESCRIPTION OF THE DRAWINGS

The present invention will now be described, by way of example with reference to the accompanying drawings, in which.

DETAILED DESCRIPTION

Figure 1A:
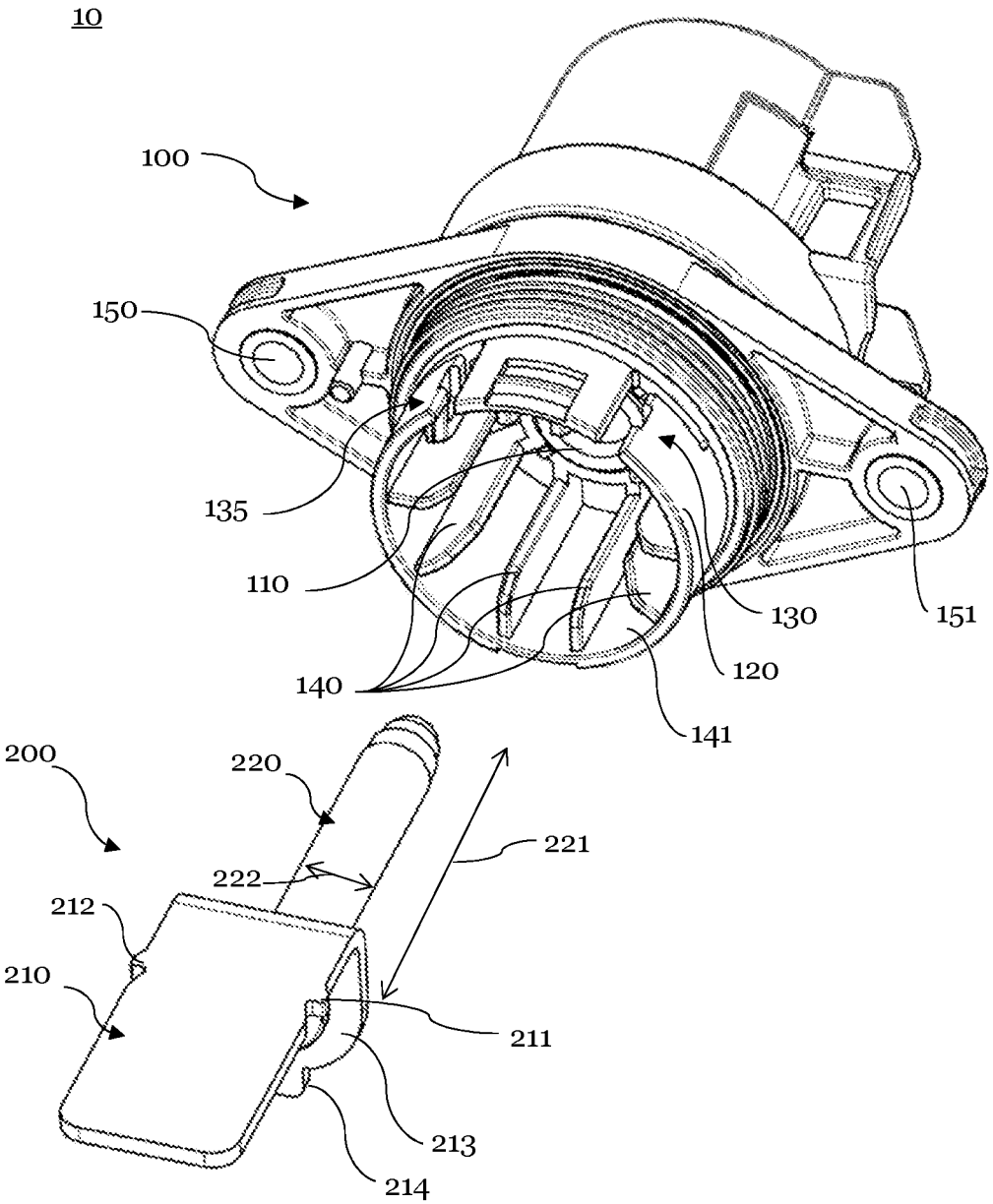
FIG. 1*a* schematically shows an interface assembly, in a three-dimensional view.

FIGS. 1*a*-3*b* show an embodiment of an interface assembly 10 for an electrical power connector. The interface assembly 10 includes an interface housing 100 and an electrical contact element 200.

The interface housing 100 includes a receiving portion 110, which may be configured to receive at least a part of the electrical contact element 200, in particular a plug-in portion 220 thereof. The receiving portion 110 is arranged inside a cavity and may include a through hole configured for receiving the plug-in portion 220 of the electrical contact element 200. After mating the electrical contact element 200 and the interface housing 100, the plug-in portion 220 may be connected to a respective electrical element (not shown in FIG. 1), e.g., a counter connector, a socket, a cable or others, which may be also mated with the interface housing 100 on a backside, opposite to the shown cavity.

The interface housing 100 further includes an essentially cylindrical wall component 120, which encases the cavity and the receiving portion 110 at least partly. The axis of the receiving portion 110 and the axis of the essentially cylindrical wall component 120 may coincide and extend in a mating direction 300 of the electrical contact element 200. The essentially cylindrical wall component 120 can resemble a segment of a hollow cylinder, in which a center angle of a base area may range from between 120° and 360° to between 190° and 270°. A diameter 121 of the essentially cylindrical wall component 120 may range between 30 mm and 60 mm and the thickness 122 of the essentially cylindrical wall component 120 may be between 1.5 mm and 3 mm.

Figure 2:
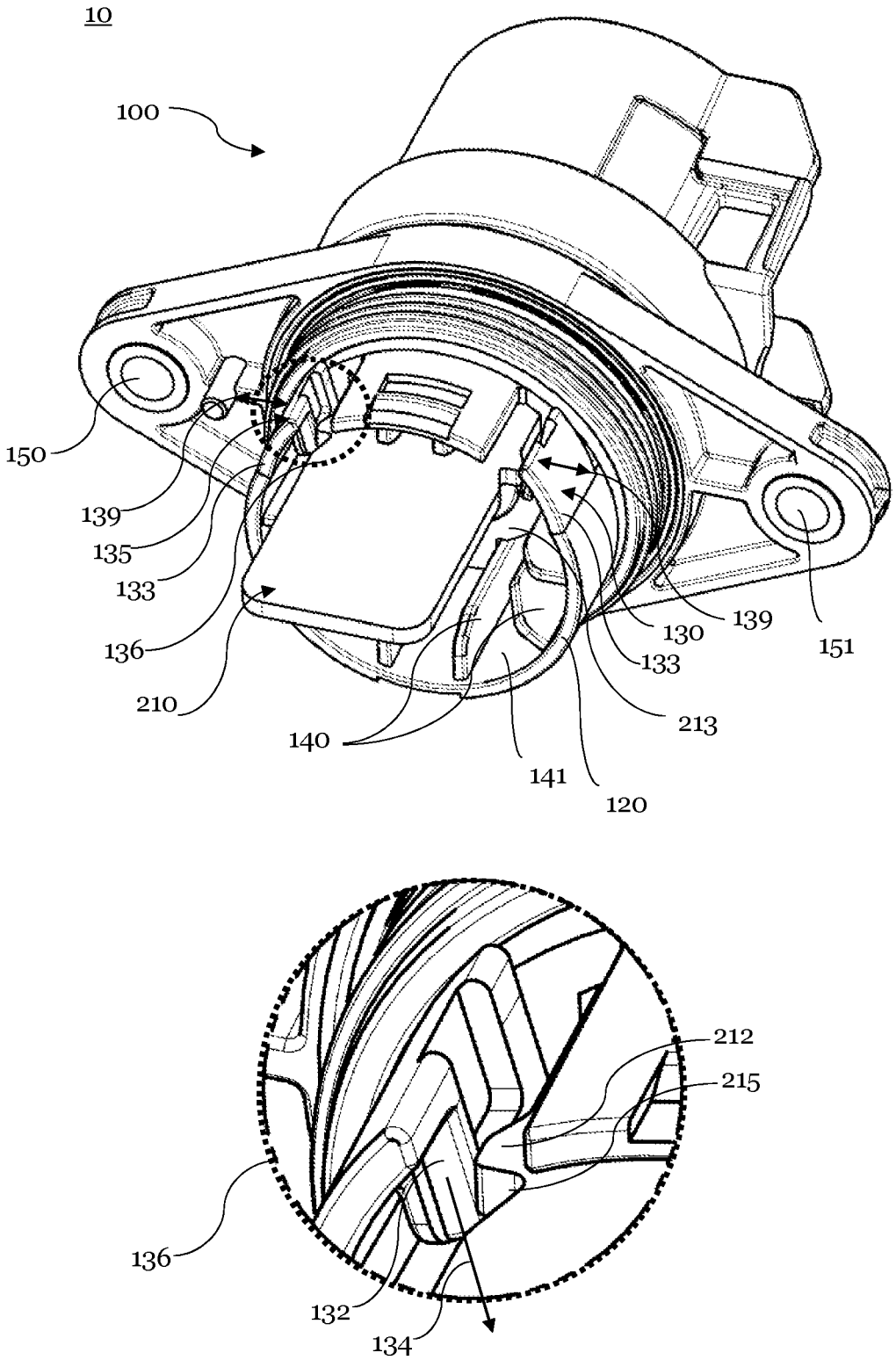
FIG. 2 schematically shows the interface assembly of FIG. 1 upon mating, including a detail of the latch elements.

The interface housing 100 further includes two latches 130, 135. The two latches 130, 135 can be arranged on an interior surface 141 of the cylindrical wall component 120. The two latches 130, 135 may further be arranged on a spring element 133, which is configured to elastically deflect in a direction 139 perpendicular to the mating direction 300 (s. FIG. 2). The spring element 133 can be attached to the open edges of the segment of a hollow cylinder, such as e.g., the essentially cylindrical wall component 120. Alternatively, the spring element 133 can also be integrally formed with the essentially cylindrical wall component 120, which may provide a cost-efficient manufacture of the spring element 133. It may be noted that to enable deflection of spring element 133, the spring element 133 may be not in contact with the interface housing 100. In contrast, the essentially cylindrical wall component 120 may be arranged in contact with the interface housing 100 at least for the most part.

The interface housing 100 includes at least one securing means being formed as a through hole 150, 151. In the embodiment illustrated in the Figures, two through holes are present. However, also different numbers of securing means are applicable. Each of the through holes 150, 151 serves for receiving a further securing element, such as a screw or a bolt, for securing the interface housing 100 to a counterpart (not shown).

The interface assembly 10 further includes an electrical contact element 200, which is configured to transfer electrical power in the range of at least 5 kW up to at least 30 kW, in particular in a higher voltage vehicle system, such as a 48 volts vehicle electrical system. The electrical contact element 200 includes a busbar portion 210, which may resemble a metallic strip or bar. Busbar portion 210 includes the two latching noses 211, 212, which in combination with the two latches 130, 135 are configured to block a release-ment movement of the electrical contact element 200 after mating with the interface housing 100. The two latching noses 211, 212 may be arranged on opposite sides of the busbar portion 210 and may extend perpendicular to the mating direction in a plane of the busbar portion 210.

The busbar portion 210 further includes a fixation portion 213, which can be integrally formed with the busbar portion 210 or attached to it separately. The fixation portion 213 extends perpendicular to the mating direction 300 and may be formed by bending the respective end of the bus bar portion 210, if both elements are formed integrally. The fixation portion 213 has an outer guiding contour 214, which is configured to fit into a corresponding contour 140 on an interior surface 141 of the interface housing 100 inside the interface cavity. The corresponding contour 140 may closely encase the outer guiding contour 214, after mating, to prevent rotations or misplacements of the electrical contact element 200 and allow for a firm fit inside the interface housing 100.

The electrical contact element 200 further includes a plug-in portion 220, which is secured to the fixation portion 213. For example, the plug-in portion 220 may be secured to the fixation portion 213 by inserting the plug-in portion 220 into a hole of the fixation portion 213. After the inserting, a collar of the plug-in portion 220 may be pressed onto the fixation portion 213 so that a collar area of the plug-in portion 220 may be firmly fixed with the fixation portion 213. The plug-in portion 220 has an essentially cylindrical shape and is configured to be guided into the receiving portion 110 of the interface housing 100. A diameter 222 of the plug-in portion 220 may range between 6 mm and 10 mm and a length 221 of the plug-in portion 220 may range between 30 mm and 50 mm.

Figure 1B:
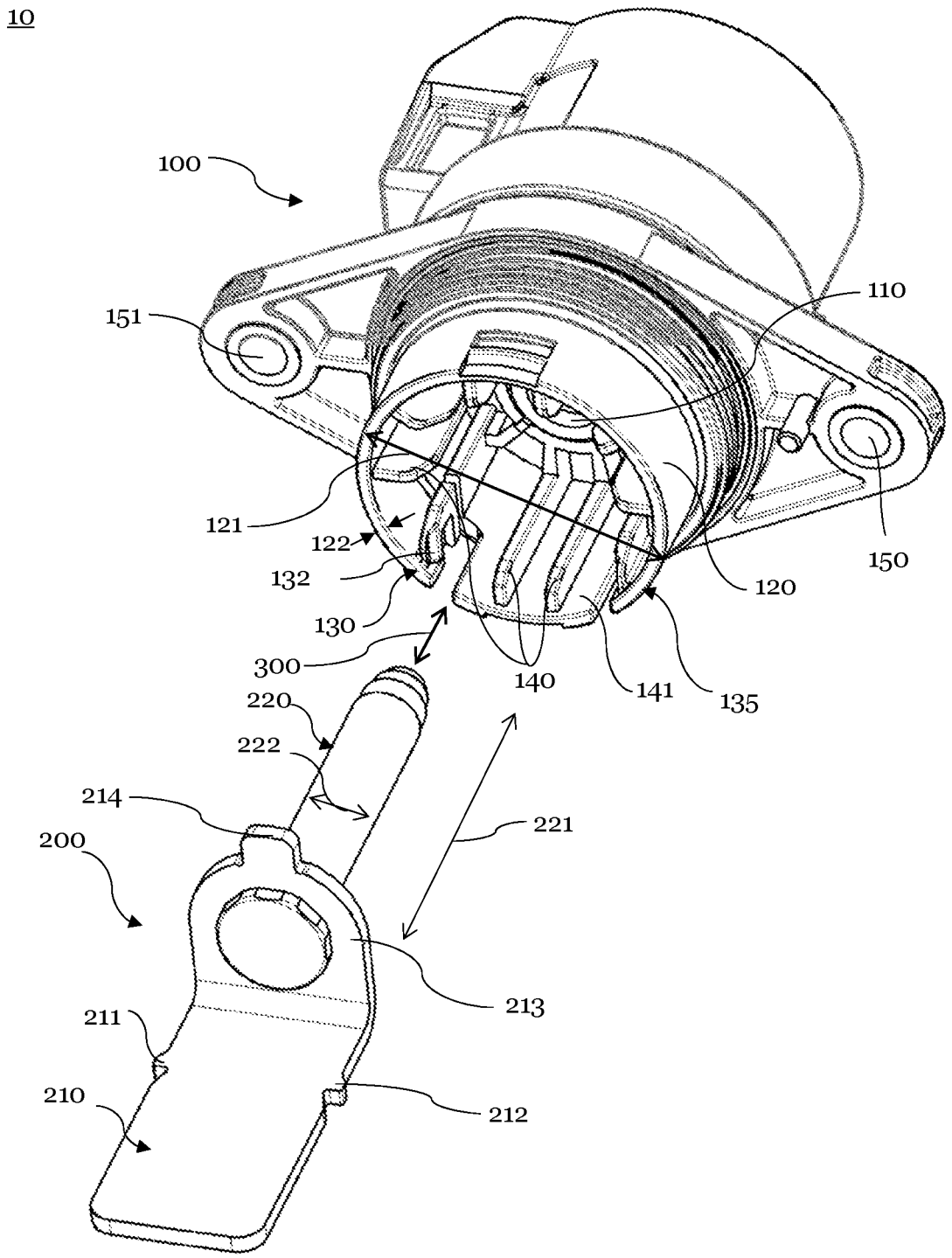
FIG. 1*b* schematically shows the interface assembly of FIG. 1, rotated by 180° around the mating direction.
Figure 3A:
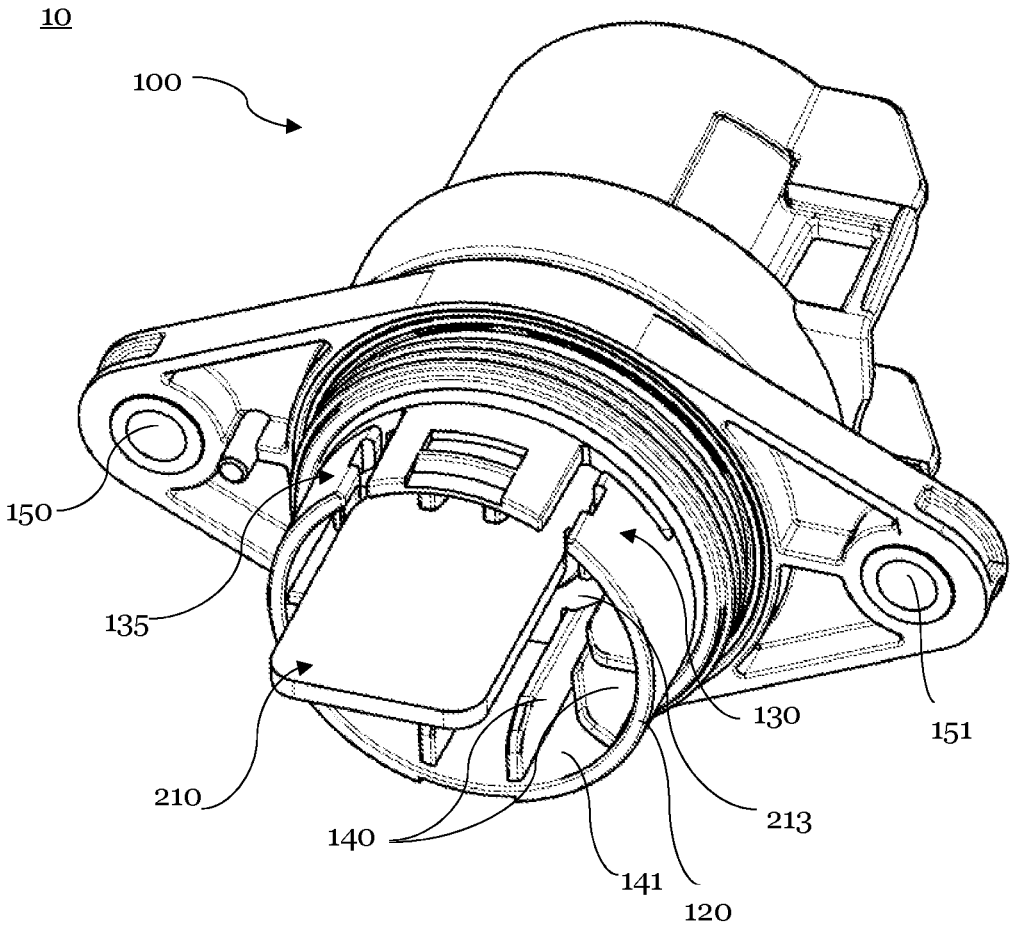
FIG. 3*a* schematically shows the interface assembly of FIG. 1 when mated.
Figure 3B:
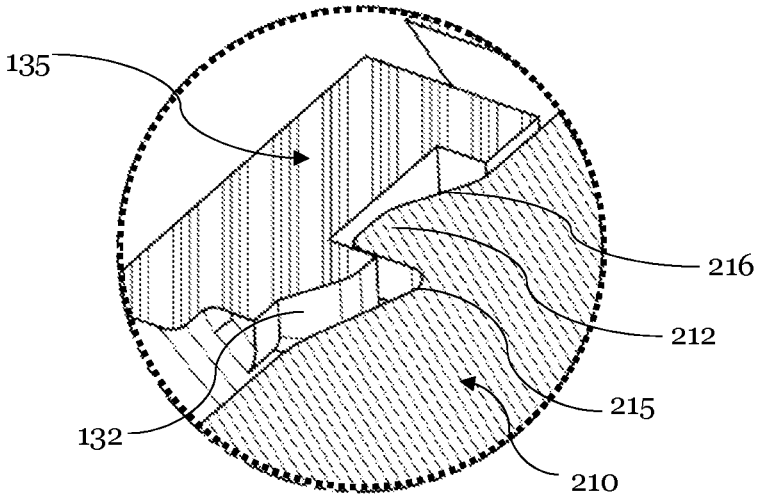
FIG. 3*b* schematically shows a close-up view of the interface assembly of FIG. 1 when mated.

While FIG. 1*a* shows the embodiment of the interface assembly 10, FIG. 1*b* illustrates the interface assembly 10 rotated by 180° around the mating direction 300, to allow for a detailed visibility of all components. To further illustrate a mating of the interface housing 100 with the electrical contact element 200, FIG. 2 shows an intermediate state during a mating process, while FIGS. 3*a* and 3*b* illustrate the interface assembly 10 after mating.

In some embodiments of the present disclosure, each latch 130, 135 can be configured to slide along the assigned latching nose 211, 212 during mating. To allow for an easier and/or improved latching, an edge of each latch 130, 135 may be belled. Therefore, each latch 130, 135 includes a first inclined surface 132. A surface normal 134 of the first inclined surface 132 points advantageously towards mating direction 300. Similarly, a portion of each latching nose 211, 212, which during mating is sliding along the first inclined surface 132, may also include an inclined surface, i.e., the second inclined surface 216. This may provide an improved sliding of the first inclined surface 132 on the second inclined surface 216 during mating which may run essentially parallel. FIG. 2 further shows the deflection of the spring element 133 during mating. An enlarged section 136 illustrates an exemplary arrangement of the first and second inclined surfaces 132 and 216 during mating.

In some embodiments of the present disclosure, the busbar portion 210 further includes a recess 215. The recess 215 is located essentially subsequent to latching noses 211, 212, when seen from the receiving portion 110 along mating direction 300. The recess 215 extends in the plane of the busbar portion 210. An exemplary arrangement of latch 135 and corresponding latching nose 212, which may similarly, in particular mirror-symmetrically, also represent an arrangement of the latching nose 211 and latch 130, is illustrated in an enlarged view in FIG. 3*b*. In this manner, each of the latching noses 211, 212 can be received within the recess 215 after mating for efficiently blocking an unintended release movement of the latching noses 211, 212. However, if required, the present embodiment may allow an unlatching of the electrical contact element 200 from the interface housing 100 without breaking of any securing means. By intentionally deflecting the latches 130, 135 manually or using a tool in a direction 139 perpendicular to the mating direction 300, the latching noses 211, 212 can be released from the latches 130, 135. Thus, the electrical contact element can be easily removed. Advantageously of the present embodiment, the latching system can be reused multiple times.

LISTING OF REFERENCE NUMBERS

10 interface assembly
100 interface housing
110 receiving portion
120 cylindrical wall component
121 diameter of the cylindrical wall component
122 thickness of the cylindrical wall component
130, 135 latch
132 first inclined surface
133 spring element
134 normal surface
136 enlarged section
139 deflection direction
140 corresponding contour
141 interior surface
150, 151 through hole
200 electrical contact element
210 busbar portion
211, 212 latching nose
213 fixation portion
214 outer contour
215 recess
216 second inclined surface
220 plug-in portion
221 length of the plug-in portion
222 diameter of the plug-in portion
300 mating direction

The invention claimed is:

1. An interface assembly for an electrical power connector, comprising:

an interface housing comprising a receiving portion arranged inside an interface cavity of the interface housing, for receiving an electrical contact element, the interface housing further comprising at least two latches; and the electrical contact element for transferring electrical power comprising a busbar portion and a plug-in portion comprising an essentially cylindrical shape, wherein the busbar portion comprises at least two latching noses and wherein each of the at least two latching noses is assigned to one of the at least two latches to block a release movement of the assigned latching nose upon mating of the electrical contact element and the interface housing.

2. The interface assembly according to claim 1, wherein the interface housing further comprises an essentially cylindrical wall component, an axis of which extends in a mating direction of the electrical contact element.

3. The interface assembly according to claim 2, wherein the busbar portion comprises a fixation portion configured to hold the plug-in portion, wherein the fixation portion extends perpendicular to the mating direction and comprises an outer guiding contour, and wherein the interface housing comprises a corresponding contour arranged inside the interface cavity.

4. The interface assembly according to claim 2, wherein the essentially cylindrical wall component comprises a diameter between 30 mm and 60 mm.

5. The interface assembly according to claim 2, wherein the essentially cylindrical wall component comprises a thickness of the wall component between 1.5 mm and 3 mm.

6. The interface assembly according to claim 2, wherein the at least two latching noses are arranged on opposite sides of the busbar portion extending perpendicular to the mating direction of the electrical contact element in a plane of the busbar portion.

7. The interface assembly according to claim 1, wherein the electrical contact element is configured to transfer electrical power of at least 5 kW.

8. The interface assembly according to claim 1, wherein a portion of each latch is configured to slide along the assigned latching nose during mating and wherein a portion of each latch comprises a first inclined surface such that a normal surface of the first inclined surface points towards a mating direction of the electrical contact element.

9. The interface assembly according to claim 8, wherein the busbar portion, when viewed from the receiving portion along mating direction of the electrical contact element, comprises a recess subsequent to the latching nose and wherein the recess extends coplanar with the busbar portion and is configured that the first inclined surface of each of the latches can be received within the recess after mating.

10. The interface assembly according to claim 1, wherein the plug-in portion comprises a diameter perpendicular to mating direction of the electrical contact element between 6 mm and 10 mm.

11. The interface assembly according to claim 1, wherein the plug-in portion comprises a length in a mating direction between 30 mm and 50 mm.

12. An electrical connector, comprising an interface assembly according to claim 1 and a housing that at least partly contains a plug-in portion of an electrical contacting element.

13. The interface assembly according to claim 1, wherein the busbar portion is in the form of a strip or bar.

14. An interface assembly for an electrical power connector, comprising:

an interface housing comprising a receiving portion arranged inside an interface cavity of the interface housing, for receiving an electrical contact element, the interface housing further comprising at least two latches wherein the interface housing further comprises an essentially cylindrical wall component, an axis of which extends in a mating direction of the electrical contact element and wherein the at least two latches are arranged at an interior surface of the cylindrical wall component; and the electrical contact element for transferring electrical power comprising a busbar portion and a plug-in portion, wherein the busbar portion comprises at least two latching noses and wherein each of the at least two latching noses is assigned to one of the at least two latches to block a release movement of the assigned latching nose upon mating of the electrical contact element and the interface housing.

15. The interface assembly according to claim 14, wherein each of the at least two latches are arranged on a respective spring element of the cylindrical wall component that is configured to elastically deflect in a direction perpendicular to the mating direction.

16. The interface assembly according to claim 15, wherein the respective spring element is integrally formed with the cylindrical wall component.

17. The interface assembly according to claim 16, wherein the essentially cylindrical wall component resembles a segment of a hollow cylinder, wherein a center angle of a base of the hollow cylinder is between 120° and 360° and wherein the respective spring element is arranged on an open edge of the cylindrical wall component.

18. The interface assembly according to claim 14, wherein the busbar portion is in the form of a strip or bar.

19. An interface assembly for an electrical power connector, comprising:

an interface housing comprising a receiving portion arranged inside an interface cavity of the interface housing, for receiving an electrical contact element, the interface housing further comprising at least two latches; and the electrical contact element for transferring electrical power comprising a busbar portion and a plug-in portion comprising an essentially cylindrical shape, wherein the busbar portion comprises at least two latching noses and wherein each of the at least two latching noses is assigned to one of the at least two latches to block a release movement of the assigned latching nose upon mating of the electrical contact element and the interface housing, wherein a portion of each latch is configured to slide along the assigned latching nose during mating and wherein a portion of each latch comprises a first inclined surface such that a normal surface of the first inclined surface points towards a mating direction of the electrical contact element and wherein a portion of each latching nose, which is assigned to slide along the first inclined surface of another of the at least two latches during mating, comprises a second inclined surface such that the first inclined surface of the latch and the second inclined surface of the latching nose are arranged essentially parallel during mating.

20. The interface assembly according to claim 19, wherein the busbar portion is in the form of a strip or bar.

* * * * *